US005413636A

United States Patent [19]

Smejda

[11] Patent Number: 5,413,636

[45] Date of Patent: May 9, 1995

[54] ENDLESS ROTARY PROCESSING OF SUBSTRATES IN HEAT AND VAPORS

[76] Inventor: Richard K. Smejda, P.O. Box 344, Paterson, N.J. 07544

[21] Appl. No.: 907,609

[22] Filed: Jul. 2, 1992

[51] Int. Cl.[6] ..... B05C 11/00; B05C 13/02; B05C 15/00

[52] U.S. Cl. ..... 118/64; 118/66; 118/300; 118/503; 118/715; 8/149.1; 8/149.2; 68/5 C; 68/8

[58] Field of Search ..... 118/64, 65, 66, 67, 118/68, 400, 416, 503, 715, 300; 68/5 R, 5 C, 5 D, 5 E, 8; 8/149.2, 149.3, 151; 34/155, 162, 660

[56] References Cited

U.S. PATENT DOCUMENTS

| | | | |
|---|---|---|---|
| 3,022,926 | 2/1962 | Bailey, Jr. | 68/5 C |
| 4,070,876 | 1/1978 | Thompson et al. | 68/5 C |
| 4,070,877 | 1/1978 | Fleissner | 68/5 D |
| 4,494,389 | 1/1985 | Smejd | 68/8 |
| 4,984,439 | 1/1991 | Smejda | 118/68 |

*Primary Examiner*—W. Gary Jones
*Assistant Examiner*—Steven P. Griffin

[57] ABSTRACT

This invention processes a multitude of axially centered samples, materials, and masses, in heat and vapors, all substrates and masses rotating on a multitude of center cores within bellshaped chambers, and around themselves, while each core and each substrate is accessible once during each separate rotation through the chambers for sampling, observation, termination, reinsertion, or substitution.

4 Claims, 6 Drawing Sheets

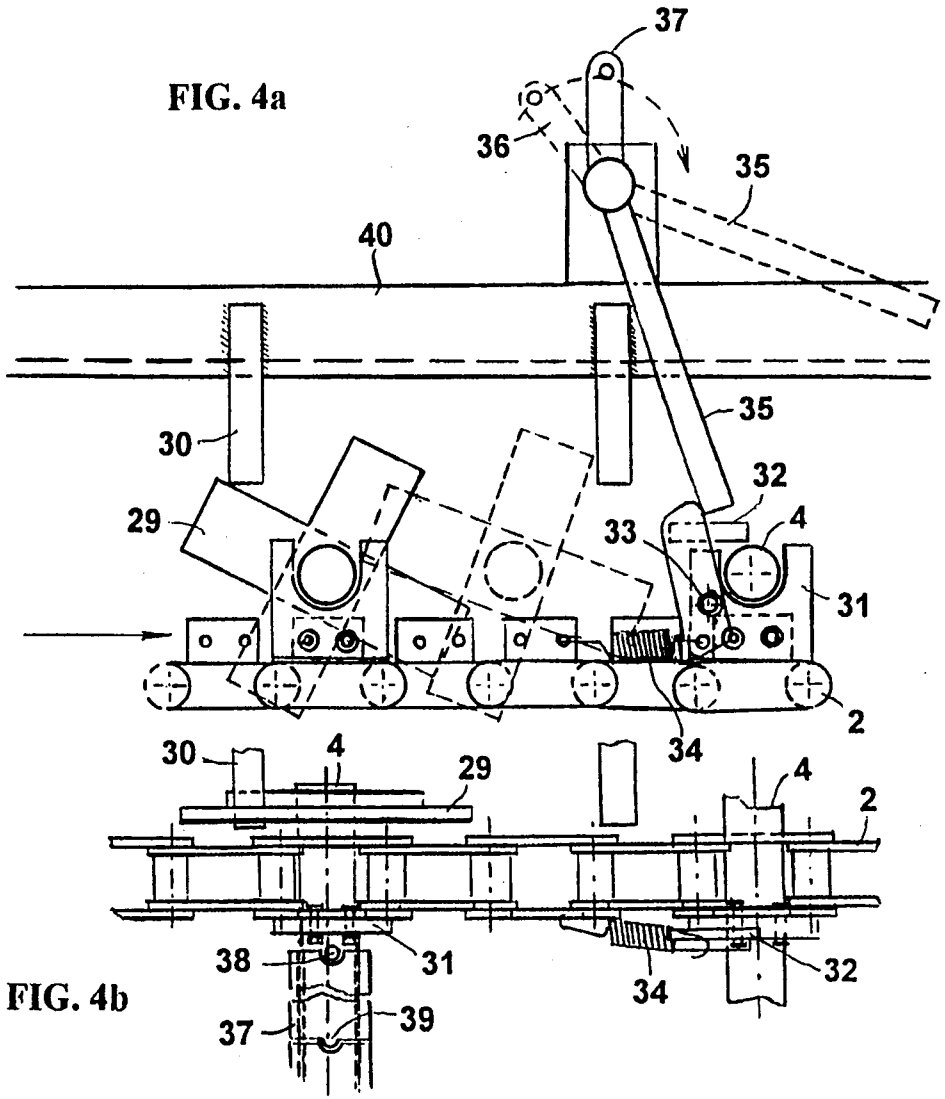
FIG. 4a
FIG. 4b
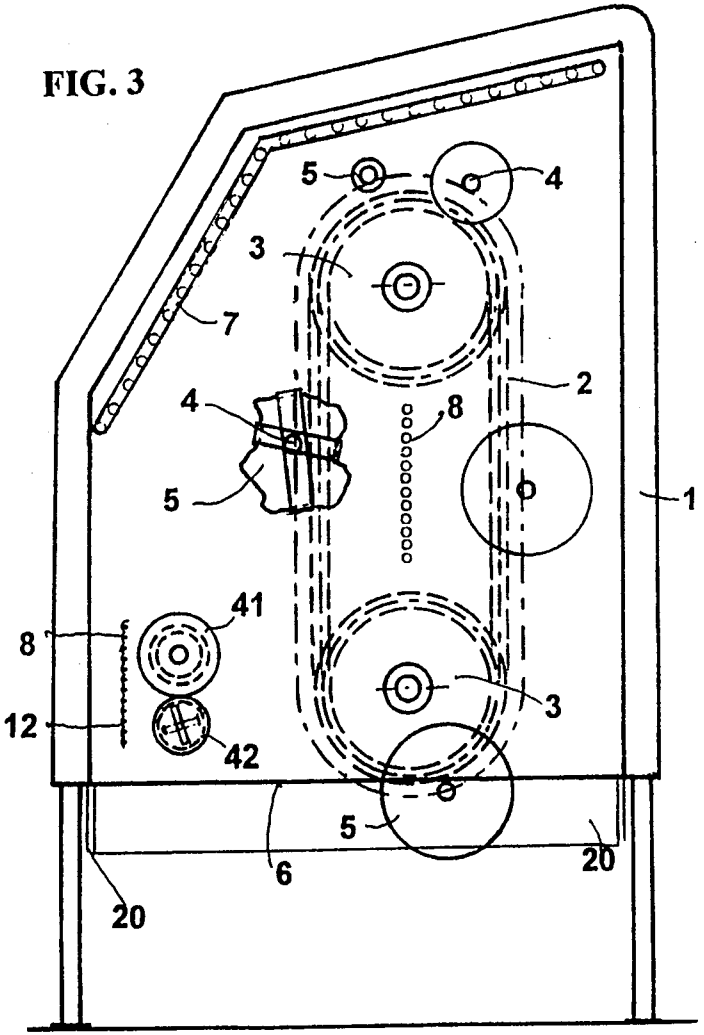
FIG. 3

ENDLESS ROTARY PROCESSING OF SUBSTRATES IN HEAT AND VAPORS

BACKGROUND OF THE INVENTION

1. Field of the Invention

This invention relates to the continuous treatment of variegated substrates, either suspended from longitudinal cores or wound around such cores in multiple layers, then heated and exposed to hot vapors in chambers. The openings for loading and exit being at the bottom of the chamber to prevent the escape of steam or vapors lighter than air. The cores carrying such substrates are secured with their extremities to individual links fastened in parallel fashion to two parallel conveyor chains. The conveyor rotates these substrates within this bellshaped chamber in such a way, as to bring each core, on each round, to the accessible lower section of the chamber, permitting manual or automated interference with any sample or substrate at every single rotation of the twin conveyor chains, or at any desired multiple of such rotations, e.g.; six rotations of ten minutes each will provide a total of sixty minutes exposure and six chances for interference. Adjustable conveyor speed permits to control processing by regulating the time of each rotation, and controlling thereby the treatment intervals for interference, sampling, removal, or entering of materials.

Means are provided to impart to any suitably equipped carrier a secondary rotation around its longitudinal axis as it moves with the conveyor through the chamber.

2. Description of the Prior Art

The present improvements are an addition and extension to the processing technology described by this inventor in the U.S. Pat. Nos. 4,494,389 and 4,984,439

SUMMARY OF THE INVENTION

It is therefore an object of the invention to provide a flexible, but controlled system for the simultaneous processing of diverse substrates, and materials differing in characteristics, lengths, components, structure, and processing periods, while being exposed to heat and designated vapors within a common enclosure.

It is another object to equalize the distribution of internal moisture, energy level, internal pressure, and internal temperature, within the bulk of substrates, or materials, by the application of internal vaporization and by the rotation of each core of substrates.

It is a further object to provide means and opportunity to interfere with any single material on any core or carrier during any rotation of the two conveyor chains, or to continue such rotation in specified units of time, variably selected and characteristic for each material or substrate.

It is a another object to furnish variable heating and energizing means within the processing chamber, acting on the materials and substrates directly and indirectly, while incorporating heat exchangers to keep the level of temperature inside the chamber, or chambers, at the designated level.

It is an additional object to process substrates and materials modified by impregnations and applications performed with padders, kissroll, magnetic rollers, squeegee, striping, printing, sponging, and lamination.

It is also an object to employ monitors, sensors, and instrumentation, with systems controls and data recording to achieve assured repeat performance.

It is a further object to apply chemical solutions, dispersions, slurries, or pastes, in any conceivable planned or random manner to the substrates and materials and process them in the designated fashion.

Other objects and advantages will become apparent from the following description in conjunction with the accompanying drawings.

BRIEF DESCRIPTION OF THE DRAWINGS

FIG. 3 is a schematic sideview of the basic two-sprocket conveyor in relation to FIGS. 4*a* and 4*b* and secondary rotation of the cores.

FIG. 4*a* is a schematic illustration of the sideview; and

FIG. 4*b* is a schematic illustration of the topview; depicting the holding mechanism for the carriers of the substrates and star wheels used to rotate such carriers on their progress through the chamber.

DESCRIPTION OF THE PREFERRED EMBODIMENT

Figure 1B:
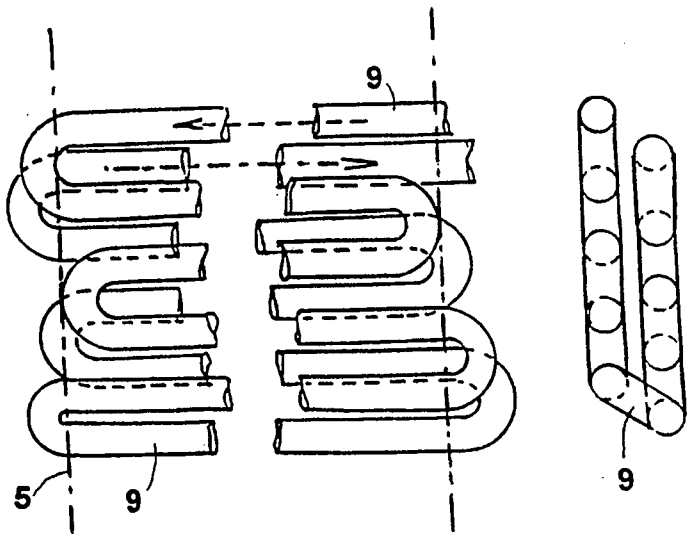
FIG. 1*b* is a schematic front- and sideview of the tube heaters using internal combustion and dispensing infrared energy.
Figure 1A:
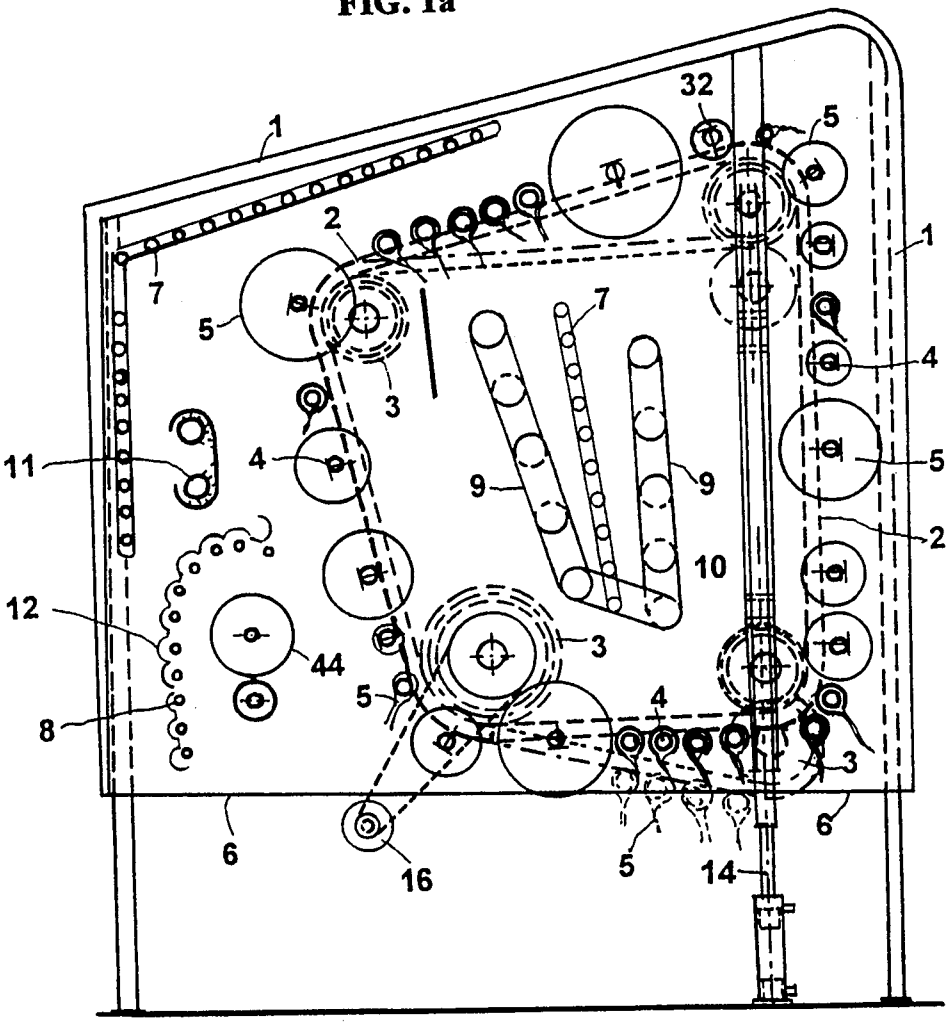
FIG. 1*a* is a schematic sideview of the housing and endless dual conveyor chains, comprising the loaded conveyor system with heating, winding, rewinding, raising, dwelling, and lowering.

FIG. 1*a* displays the insulated chamber 1 enclosing steam and/or vapors and the operating systems. It contains a pair of parallel conveyor chains 2 rotating around multiple sprockets 3, —four sprockets 3 in this illustration, a total of eight sprockets for the front and back conveyor chain (one behind the other). The chains transport the core 4 on two extremities, in locked bearings 32 (FIG. 4), while the core 4 hold the substrates 5, either as swatches, as rolls of materials, or as axially balanced mass.

The chambers are preferable clad internally by moisture proof and heat reflecting sheeting, for example stainless steel. The chamber 1 is at the bottom closed with movable partitions 6 (not detailed) to permit access, having transparent inserts for purposes of observation. They open individually to permit the passage of core 4 and substrates 5. One of the sprockets 3 is connected to the variable drive 16, preferable mounted outside the chamber 1. The drive 16 adjusts speed to provide the selected duration for each rotation of the conveyor chains 2. The total processing time of any substrate on any core 4 is the sum of all rotations plus the increment to the point of interception. Processing times are recorded for each substrate within systems control and data storage.

To facilitate access to any core 4, and for entering and descending, the two conveyor chains are equipped with movable sprockets 3 on the right For this purpose the four front and back sprockets 3, on the right, are mounted on two sliding bars 10 (behind each other). The front and back bars 10 are activated with hydraulic cylinders 14, which are raised, or lowered, jointly to bring specific cores 4 out of, or into the processing vapors. Pneumatic or mechanical means may replace the hydraulic. The shaft of one of the left sprockets 3, (in fixed position), is extended through the wall of chamber 1 and connected to the variable speed drive 16. The front and rear sprockets 3 on this drive are both keyed to the shaft to synchronize the two chains 2. The possibility of a chaindrive to the motor 16 is indicated at the lower frame of chamber 1.

Figure 2:
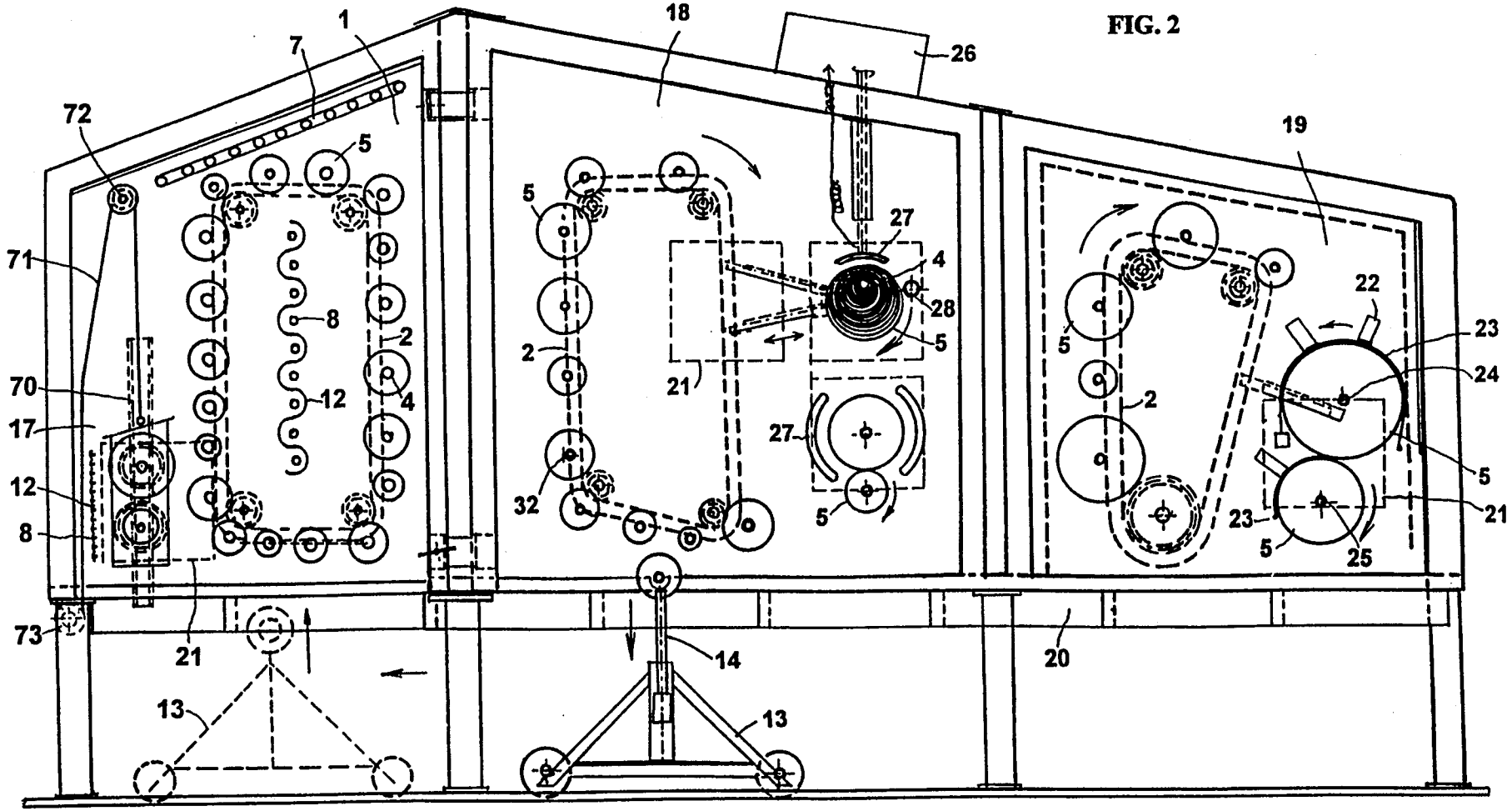
FIG. 2 is a schematic sideview of a multipurpose processing system with three chambers, plus infrared heating, high frequency heating, ultrasound treatment, and rewinding.

Two heating systems 8 and 9 are used for energizing winding and rewinding 44 and for the maintenance of the desired temperature within the chamber 1 in cooperation with the heat exchangers 7 suitably placed in chamber 1. The heaters 8 are electric infrared rods aimed at the rewinding system 44 of the FIGS. 1*a* and 2. Winding at 44 has generally the purpose to bring the substrate 5 layer by layer to the boiling point of the prevalent impregnation. Boiling confined inside a roll of materials continues as long as the surface of these materials is subject to heat transfer in excess of the boiling temperature of the prevalent impregnations. Due to laws of physics, the phase transition from rising temperature to expansion at the boil, and the condensation due to variables in volume, pressure, and temperature, are used to provide self regulating stability in the processing conditions. Varying chemical compositions and local average atmospheric pressure vary boiling temperature in coordination with location and procedure.

This internal boiling within a roll of materials is accentuated by the adjusted temperature difference between the boiling roll of materials and the adjusted temperature of the surrounding vapors. A higher differential impacts the various surfaces and is transmitted to the interior by interaction, increasing reactivity. A lower differential favors the status quo. Adding high frequency heating, and/or ultrasound activation to substrates and masses 5 will be used to further modify chemical reactivity.

The reflector baffle 12 directs heat energy towards the rewinding 44 and towards the substrates 5 on the conveyor. The curved reflector 12 improves heat transmission and protects the winding substrates 5 from start-up condensation. The gas- or fluid-fired tube heater 9 increases heat intensity at the substrates and boosts start-up time. Furnace burners can be used to inject the flame into the tubes heaters 9, while the closed tubes insulate the chamber 1 from the gases of combustion. Operating systems and production, together with heat exchangers 7 utilize the burner heat of 700 C. to 900 C. down to about 40 C. This exceeds the usual efficiency of 60% for infrared systems by far. Once the machine is at the desired operating temperature the heaters 8 may be sufficient to maintain the temperature of the required vapor/steam envelope within the chamber 1. Additional steam or vapor injection is provided with the perforated pipes 11 housed within curved baffles, which are protecting against direct exposure of the substrates and materials in process. Heaters, injection of steam and/or vapors and sprays together with mostly panel-type watercooled heat exchangers, permit exact temperature and moisture control.

The tube heaters 9 consist of one or more undulations of round or rectangular cross section of preferentially corrosion proof tubing with the option of a blackbody surface for the improved emission of infrared energy. The tube heaters 9 contain not only an elongated fluid- or gas-flame extended by pressurized air, but also along their length very hot gases of combustion, which are circulated inside the chamber 1 as processing energies. Flaps or panels (not shown), are used to protect the substrates from radiation during standstills.

The undulating tube heater 9 weaves back and forth to average diminishing emissions over their length, in respect to the bombarded substrates 5. The bends of tube heater 9 in FIG. 1*b* are staggered from loop to loop to provide lateral averaging of energy emission in regard to the salvage of the passing substrates 5. The reflecting heat exchanger panel 7 between the two arms of the tubing 9 is used to heat process water and to redirect energy towards the substrates 5. Only one panel of tube heater 9, or two separate panels, are suitable variations.

More heat exchangers 7 are judiciously located near the boundaries of the chamber 1 to regulate the vapor temperature inside the chamber and to protect the substrates against dripping of condensation at start-ups. The turbulence from the winding blends the temperature of the vapor content inside the chamber. It adds convection to the radiation. Cores 4 provide some conduction toward the interior of the rolled materials. Insulated cores 4 are selected to limit such conduction, or for high frequency heating.

Whenever desirable the substrates 5 are wrapped into covers, especially whenever substrates are treated below the temperature of boiling. In such circumstances the covers can provide protection and insulation, FIG. 2 explains the utility of specialized processing of substrates: A larger chamber is divided into three diversified sectors, consisting at one extremity of a steam treating chamber 1 similar to FIG. 1 and in addition one ultrasound chamber 19 and one high frequency chamber 18.

The chamber 1 carries the two conveyor chains 2, heated by infrared rods 8, and wavelike reflectors 12 distributing the heat evenly. Heat exchangers 7 control the chamber temperature. The winding/rewinding frame 17 is fixed movably up and down for loading and unloading within two guiding channels 70. The cable 71 reverses direction over the two pulleys 72 and is coiled around the winch 73 to activate lift or release. A sight-window 21 permits observation.

Carriages 13 are movable on a pair of rails and connect the chamber 1 with the chambers 18 and 19, thereby loading and unloading carriers 4 with substrates 5 at discretion. Mechanical or hydraulic lifters 14 connect the carriages 13 to the snap-in, snap-out fasteners 32 periodically attached to the chains 2; FIG. 4*a* or *b*. The carriages 13 and the fasteners 32 are aligned for coordination exactly at ninety degrees to the two rails. Plastic skirts 20 protect the moving substrates. Sight-windows 21, along with sensors, facilitate control of the operation.

The chamber 19 has sound-, and vibration-dampening walls and may be filled as required with air, steam, or vapors, at discretionary temperatures. One or more rows of ultrasound horns 22 are staggered adjustably along the width of the rolls of substrates, or masses 5. Loosely wound rolls of substrates 5 present a compact volume of layers at the upper half of the roll due to the weight of the materials impacting against the core 4. Since ultrasound favors action on compact substances the horns 22 are pressed against the tight upper half of all rolls of substrates, the lower half may be hanging tight, slack, or loose. The horns 22 are mounted adjustably on a crossbar and are subject to regulated pressure against the surface of the substrates, or masses. A slipping layer of sheeting 23 is interspersed between the horns 22 and the surface of the substrates 5 to prevent dislocation of this surface by the sliding horns 22. The sheeting 23 is held firmly on the side of the drag and carries a counterweight, or spring-attachment on the opposite end for the easy exchange of rolls, or instead of the weight the open end of 23 slides just underneath the top layer of the lower rewinding roll/substrate 5 at the bracket 25. For processing the substrates are lifted at the extremities of the core 4 into the upper bracket 24 of the of the substrate hangs down below the frame of chamber 18 and is fixed around a second core 4 positioned on the two lifters 14 of carriage 13 before being lifted into the lower bracket 25 for the rewinding tight or loose, through the ultrasonic exposure. For removal after rewinding this operation is reversed.

The substrates may consist of fabrics, yarns, fibers, paper, plastic, foam, metalsheeting, solid or amorphous masses, or any combination thereof.

On the roof of the chamber 18 sits the high-frequency generator 26 feeding DC-current to the inductive upper plate electrode 27 positioned on the firm side of the tight/loose roll of substrates 5. Electrode 27 exchanges pulses with the center electrode used as core 4 inside the roll of substrates 5. At the interior a non-conducting sleeve provides the required insulating gap between the core 4 and the substrate 5. The scroll-roller and surface drive 28 touches the substrates at a point where tight or loose substrates 5 present a solid volume to the drive 28, to assure a hold for the surface drive. Of course a combination of a faster center drive at 4 with a slower friction drive at 28 will provide additional loose winding.

As second choice capacitive high frequency heating can be installed by using two plate electrodes 27 to the left and right of the substrate 5. The choice depends largely on the substrates encountered. Electrical resistance heating with a sliding or rolling contact against the rotating substrate 5 and the core 4 used as the ground is another possibility.

In all cases the metalshafts, drives and brackets of the core 4 are insulated and shielded against currents and magnetism. Protective covers may also be provided for the substrates themselves during all processing within this innovation.

FIG. 3 is a schematic view of the basic design of this endless processing chain. Larger sprockets 3 make room for bigger loads of substrates 5. The compact design makes for faster cycles of rotation. The rods 8 adjust heating by switching in pairs. The radiation of the rods is reflected by walls made from stainless steel. One sprocket 3 is connected to the drive 16 (not shown), either by chain, or by the shaft. Three sprockets 3 may be used as in FIG. 2, 18. Tight or loose rewinding stations 41 complete the system.

Loading and unloading to the snap-in brackets 32 on the chains 2 is performed manually or with lifters. The twelve rods 8 in the center of chamber 1 and at the rewinding station 41/42 are switched on or off in pairs to adjust the working temperature in combination with the heat exchangers 7 and system controls. Flexible skirts 20 preserve heat and protect the operator.

The interior walls of chamber 1 are clad with stainless steel sheeting for corrosion resistance and to bounce back stray infrared reflectance.

In FIGS. 4*a* and 4*b* the stationary bar 30 interferes with one arm of the star wheel 29 as the cores 4 are carried past bar 30 by the chains 2. This causes the rotation of the attached core 4 by ninety degrees. The star wheels may carry four to six arms and accordingly spaced bars 30 catch one arm of the star and hold it back while the chain 2 continues to carry the core 4 with the substrate 5 forward. With four arms of the star 29, four interferences add up to a 360 degree turn of substrate 5. The bars 30 are attached to a longitudinal support 40, which extends either on one side of the core 4, or on both extremities of 4 with two stars 29 assisting the rotation. Support 40 as an angular structure restricts lateral sliding deviation of the cores 4 and assures the aligned transportation of all substrates. It also supports the weight of the cores at the bottom section of the rotational path.

Primary rotation of the substrates 5 around the path of the double chains 2 and secondary rotation around the core 4 assist in the levelling of moisture, pressure and temperature inside the substrates.

Attachments 31 are fastened to the extensions provided with the chains 2 carrying one extremity of core 4 in the slots of each chain. The slots in the attachments 31 act as bearings for the rotation of the cores 4, as initiated by the star wheels 29. The spring 34 helps lever 32 to lock the core 4 into the bearing position. It turns around the pivot 33. To insert or remove any core 4 it is necessary to free the slot of 31 with the help of the pivotally arranged double lever 35/36. The lever 35 engages the nose of lever 32 and is shown engaged at the halfpoint of freeing the slot for core 4 to be removed, —or to drop out by gravity. The customary position for the lever 35/36 is at the bottom of the chamber 1.

The cores 4 of FIG. 4b are carriers of materials made of noncorrosive rods or tubes, either carrying substrates directly on the core, or on sections of tubing 37, each one carrying narrow strips of materials. The first tubing 37 locks into the stud 38 on the core, while each following tube 37 fits its own notch into the protrusion 39 of the precedent tubing 37. The entire assembly is pressed tight and is secured in place by a set screw, or a collar. The core 4 on the right attachment 31 has no star wheel 29 and is stationary. It is used as center for swatches and small assemblies, as they are carried on the chains 2.

Figure 4C:
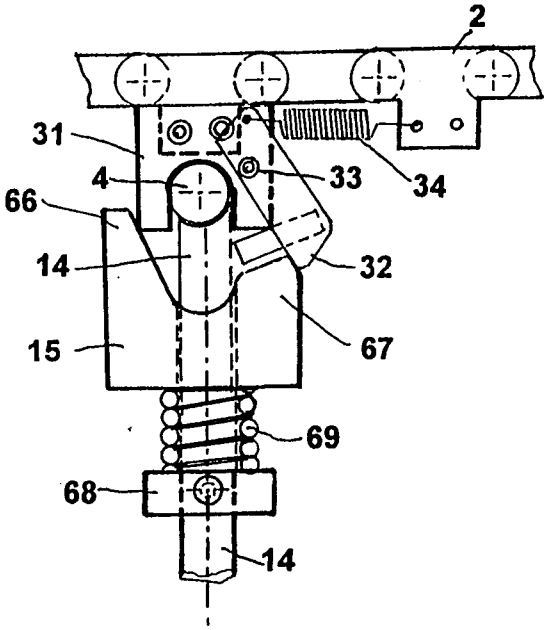
FIG. 4*c* is a schematic sideview of unloading by the carriage on rails.

FIG. 4*c* shows a schematic sideview of loading and unloading from the conveyor. For loading or unloading the carriage 13 is positioned in proximity to the pair of attachments 31 on the chains 2 to be activated. As the nose 66 of the lifter head 15 contacts the side of the attachments 31 the loading, or unloading position is fixed. The opposite side 67 of head 15 comes in contact with the nose 32 and pushes it against the resistance of spring 34 while it is pivoting at the pin 33. This parallel movement on both extremities of the core 4 opens the slots of both attachments 31 and permits the core 4 to drop out by gravity. It is supported by the two lifters 14, which have been moved upwards into contact with the two extremities of core 4, and have compressed the coilspring 69. Receding downward the lifters 14 release the core 4 into the grooves of both heads 15, while the coil 69 acts against the collar 68 and holds the head 15 in contact with the attachment 31. The core 4 is released slowly into the head 15 as the lifters 14 continue to recede into the carriage 13. Loading is the opposite procedure. The lifters 14 are lowered further and the carriage 13 is ready to assume a new position in the wet-processing line.

Figure 4D:
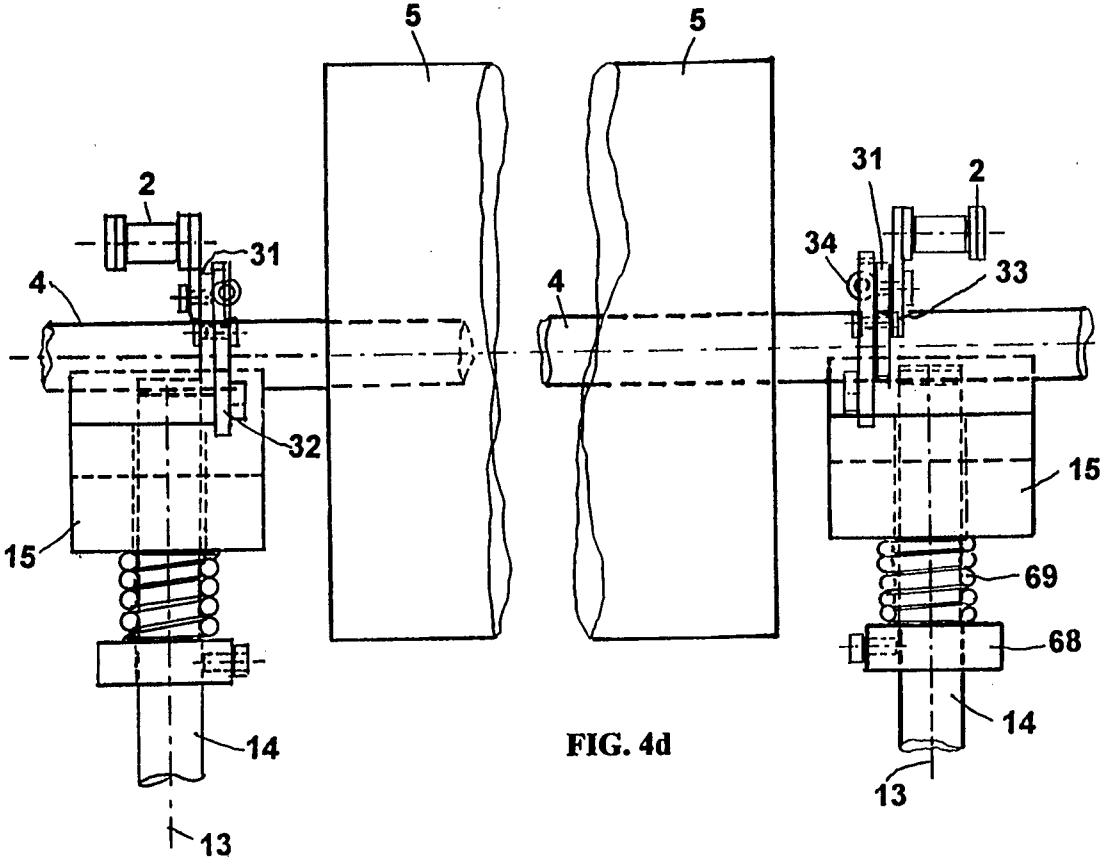
FIG. 4*d* is a front view of 4*c*, showing both conveyor chains.

The FIG. 4*d* illustrates a schematic front view of the interference for loading and removal of cores and substrates at the lower horizontal positions of the chains 2 and cores 4. Both lateral extremities of core 4 and both chains 2 are shown. The wound substrate 5 on core 4 is shown in two parts.

Figure 5B:
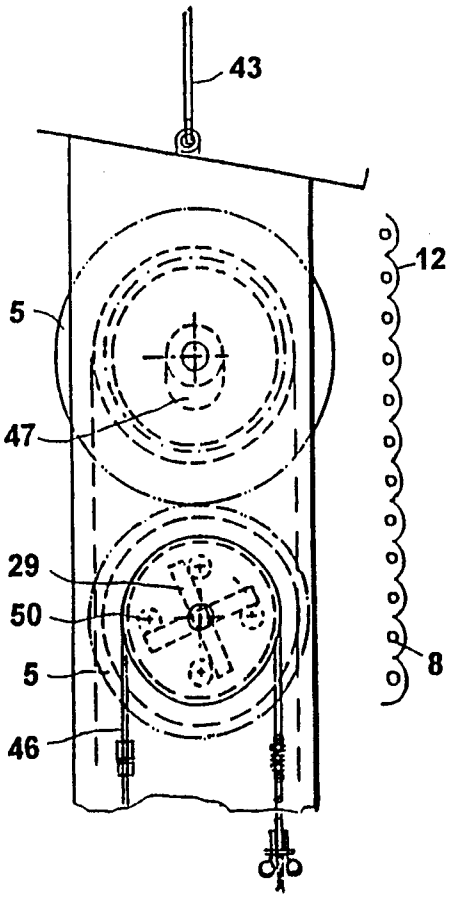
FIG. 5*b* is a schematic sideview of tight or loose rewinding, heating by layers.
Figure 5A:
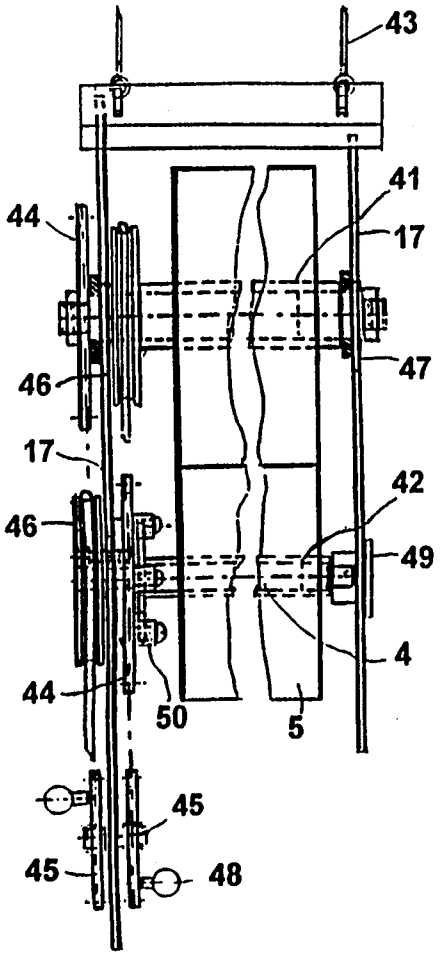
FIG. 5*a* is a schematic frontview.

FIGS. 5*a* and 5*b* depict the winding mechanism in front and side view. The process of winding and rewinding equalizes exposure to time and temperature between beginning and end of the substrates 5. This means winding up to the fixed top position 41 and again winding down to the exchangeable bottom position 42, —which is also more accessible to handling. The winding assembly 13 is suspended by the dual cable 43 and is descended with a winch for sampling, removal, or entry.

The upper and lower sprockets 44 are connected by chains or belts to the two independent drives 45 extending below the steam and heating area of chamber 1. The individual drives 45 operate manually or by motor. The cores 41 and 42 carry also two sheaves outfitted with beltbrakes 46. On winding up, the lower brake is engaged. On winding down the upper brake is used for tight winding, or instead both upper and lower drives are activated, with the upper drive providing a small overfeed to achieve a loose roll at the lower core 42. The core 41 sits in the slotted bearing 47, which permits a surface drive by the friction obtained from gravity. With the upper brake 46, or the upper drive 44 engaged, a choice of tight or loose winding is obtained. The knobs 48 on the drives 45 symbolize manual activation.

To insert a loaded core 4 into the lower winding 42 the left end of core 4 is inserted into the center of the lower sprocket 44, while the other extremity of 4 slides sideways into bearing 49. The bearing is then locked by a lever or bolt to hold the core 4 securely. Four studs 50 on the sprocket 44 engage the four arms of the star wheel 29 in order to connect to the drive. To disengage, the bearing 49 is unlocked and the core 4 is able to slide out.

A stationary array of heating elements, for example rods 8 are aligned with the the winding assembly 13, and are projected to the substrates by the reflectors 12. These are switched on or off in sections of two or three.

Figure 6:
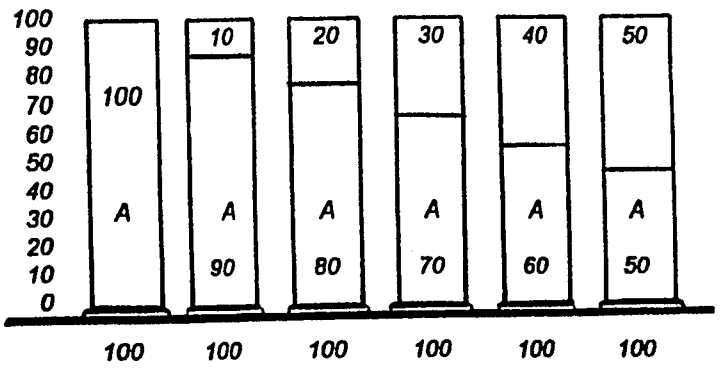
FIG. 6 describes an arithmetical or geometrical series of proportional matter.

In FIG. 6 one half of a full scale of eleven gradations of two formulations is displayed. They would run in increments of tens from 90A/10B to 10A/90B, with 100% A and 100% B being displayed at both ends,- showing eleven gradations. However five gradations may already include the desired determination. After displaying either 10/90 to 50/50, or 50/50 to 90/10, or both, the second sample run selects the closest match of the target, say 65A/35B and spreads it again into five or ten elements, e.g.; 58/42; 61/39; 64/36; 67/33; 70/30; of a corrected starting formulation of A and B. A further refinement could illustrate in the same run 61.2% A/38.8% B; 61.3% A/38.7% B; 61.4% A/38.6% B; 61.5% A/38.5% B; 61.6% A/38.4% B; and 61.7% A/38.3% B.

A and B may be any composition of selfshades, binary mixtures, and multiple blends, plus a huge potential of chemical auxiliaries. All mixtures on the same core 4 are processed under identical conditions. However sections of tubing 37 may be removed individually, or samples may be peeled off. Several substrates can be sewn together and compared. Strips can be cut into multiple parts and subjected to different conditions. Identical conditions and repeatability of results are part of this improvement, simplifying the required process controls. The recorded procedures of this small to intermediate production unit are repeatable in larger production machines. Hundreds of such groups are run simultaneously. The formulations are composed in graduates or measured by automatic systems and struck off in the applicators of FIG. 7. The resulting depositions on substrates 5 are striped next to each other in swatches up to production quantities, and are developed in the chamber 1 under exactly identical conditions for best comparative value. After selecting the target formulation, the remainder is sorted into files to facilitate future selections and definitions.

Figure 7:
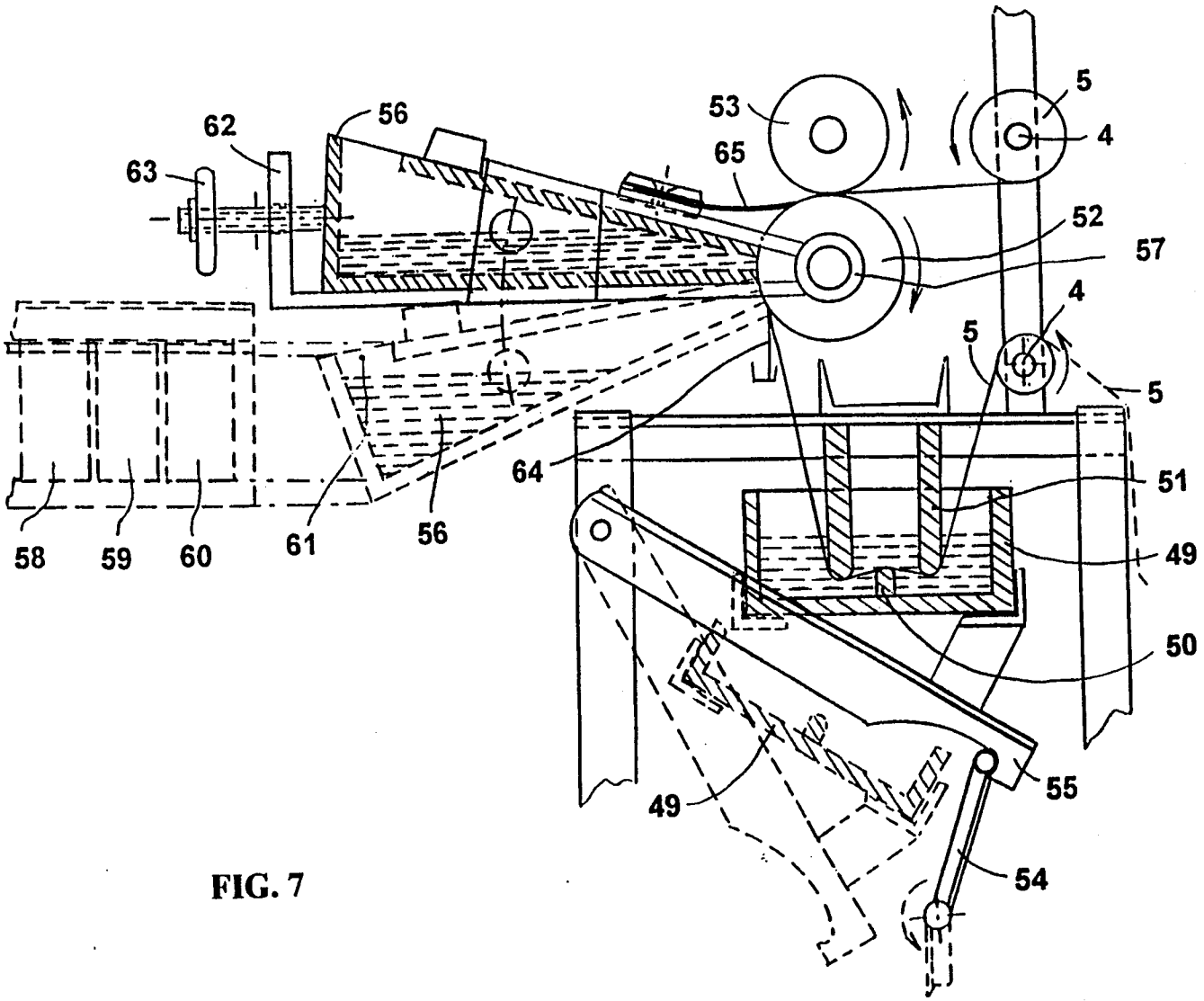
FIG. 7 exemplifies a schematic combination of padding and/or striping in one applicator system.

In FIG. 7 all types of applicators can be used to present substrates 5 for this operation. They may be padders, kiss-rolls, vacuum extractions, screenprints, rollerprints, magnetic roller applications, striping, spraying, strikeoffs, and random deposits, —singly, or in combinations. The applications consist of solutions, dispersions, slurries, pastes, powders, or any combination thereof. The substrates 5 may be run dry or wet through the system.

One liquid impregnation is illustrated, starting with the roll of substrates 5 wound on the core 4, which is mounted in a take-off position on one upright frame. The substrates may also be drawn from an open-width depository. The substrate 5 is laced into the box 49 filled with the liquid preparation. The box 49 contains one lateral center bar 50 pointing up and two stationary bars 51 pushing down. The bars 50 and 51 serve to assist in the penetration of the substrate 5 as it slides over the protrusions. For delicate fabrics the bars are replaced by one or more immersion rollers. From the bar 51 the substrate 5 moves up and is squeezed between the nip of the two pressurized rollers 52 and 53 to be wound up for transfer on the driven core 4 to the right. Spray effects may be added to the substrate 5 in the space between the rollers 52/53 and the wind-up 4.

For cleaning the box 49 is released by turning the support 54 to the left, which tilts the box 49 and the frame 55 down and permits to take it out and to replace it with an alternate box.

Another choice is the stripe applicator 56, using the roller 52 as backup and, seal and pressing the substrate 5 against 52. The applicator 56 is compartmented to hold different stripes, each one filling one or more spaces 58, 59, 60, etc. It may be filled as desired, but is also destined to transfer graduated compositions as outlined in FIG. 6. For filling of the compartments 58 . . . , the applicator 56 is often tilted down and each compartment is filled through the opening 61. Automatic filling during operation is another choice. The front of the applicator 56 is ground to a sealing fit with the roller 52 and held in the axially movable cradle 62. Two or more screws 63 are used to adjust the pressure of contact in respect to the roller 52. The cradle is axially anchored against the roller 52 by the bearing 57. After the pressure is applied the applicator 56 is moved into the upward position by screw or ratched means and the liquid fill moves by gravity forward to contact the substrate 5. The rollers 52/53 and the windup 4 are started to begin striping. The substrates may be drawn directly from the take-off 4/5, or may be guided first through the box 49. In case of striping wet substrates the knife 64 is installed to catch any accumulation of surplus liquid and guide it to the lateral disposal. The knife 65 serves the purpose to catch liquid returns from the squeeze rollers 52/53, collect it laterally, and prevent contamination of the stripe applicator 56.

Numerous modifications and variations in the invention illustrated above are expected to occur to those skilled in the art. Consequently only such limitations as appear in the appended claims should be placed thereon.

What I claim is:

1. A system for processing materials and substrates, with applicators, conveyors with surface transport, and chambers filled with vapors, wherein the improvement comprises;

one or more workstations selected from the group consisting of applicators, energizers, winders, rewinders, resetters, and processing locations;

said one or more workstations comprising;

at least one bell-shaped processing chamber containing conveyor chains for holding and transporting loaded cores at extremities of the loaded cores;

said extremities of the loaded cores being held in locked bearings for said holding and transporting with said extremities ending in star wheels with multiple arms;

means to interfere with said loaded cores during rotation of the conveyor chains; and said means to interfere comprising stationary bars mounted in sequence along a path of said conveyor chains in order to rotate one arm of said star wheel and with it said loaded core for a sector of a circle, with multiple interferences between said stationary bars and said arms of said star wheel causing said loaded core to rotate around a complete circle.

2. The system of claim 1, wherein said conveyor chains carry a plurality of attachments, said attachments having gripping and releasing means to hold and act as bearings for the extremities of said loaded cores.

3. The system of claim 1, wherein said at least one bell-shaped processing chamber is filled with fluids selected from the group consisting of steam, vapors, gases, sprays, and air at any temperature from freezing to the near-melting point of said substrates and materials.

4. The system of claim 1, comprising said bell-shaped processing chambers being insulated, internally reflecting chambers with movable closing panels having sight windows;

winding and rewinding mechanism positioned inside said bell-shaped chambers; and driving means and braking means for controlling said winding and rewinding mechanisms.

* * * * *